United States Patent [19]

Mort

[11] Patent Number: 4,694,675

[45] Date of Patent: Sep. 22, 1987

[54] METHOD OF MAKING A CONNECTOR PLATE

[75] Inventor: Edgar A. Mort, Poland, Ohio

[73] Assignee: Inter-Lock Steel Company, Inc., East Palestine, Ohio

[21] Appl. No.: 894,875

[22] Filed: Aug. 8, 1986

[51] Int. Cl.[4] ..... B21D 31/02

[52] U.S. Cl. ..... 72/325; 10/33; 72/379

[58] Field of Search ..... 10/33, 41; 72/325, 326, 72/379; 411/460, 461, 466, 467, 468

[56] References Cited

U.S. PATENT DOCUMENTS

| | | | |
|---|---|---|---|
| 159,410 | 2/1875 | Harrington | 10/41 |
| 457,583 | 8/1891 | Goldie | 10/33 X |
| 3,242,788 | 3/1966 | Broder | 411/468 |
| 3,633,454 | 1/1972 | Schmitt et al. | 411/468 |
| 4,235,148 | 11/1980 | Menge | 411/466 |
| 4,318,652 | 3/1982 | Gore | 411/468 |

*Primary Examiner*—E. Michael Combs
*Attorney, Agent, or Firm*—Harpman & Harpman

[57] ABSTRACT

A connector plate for rigidly securing two intersecting wood members of a wood structure together in abutting relation is formed of sheet steel or the like with a plurality of pairs of teeth struck therefrom and extending perpendicularly to the plane of the plate, each of the teeth having a sharpened outermost end formed by initially stamping a plurality of grooves in the sheet steel plate diagonally with respect to the areas from which the plurality of pairs of teeth are subsequently struck.

4 Claims, 5 Drawing Figures

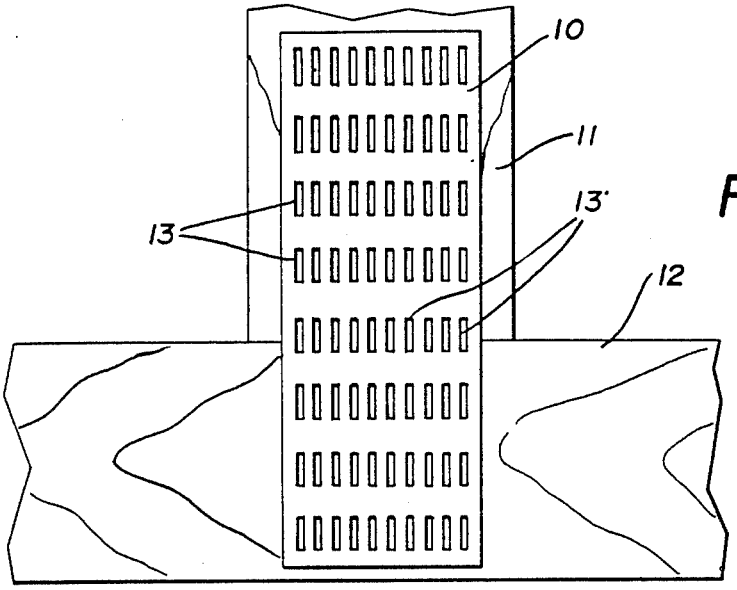
FIG. 1
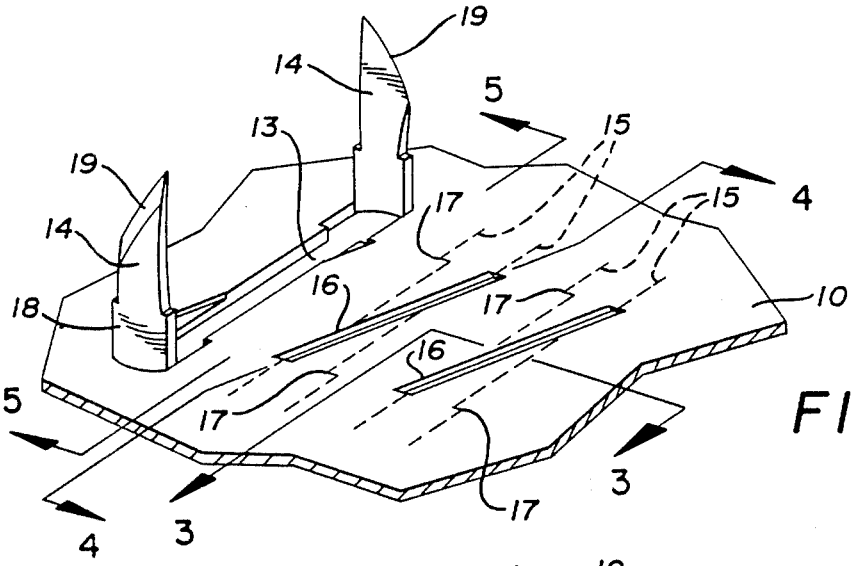
FIG. 2
FIG. 3
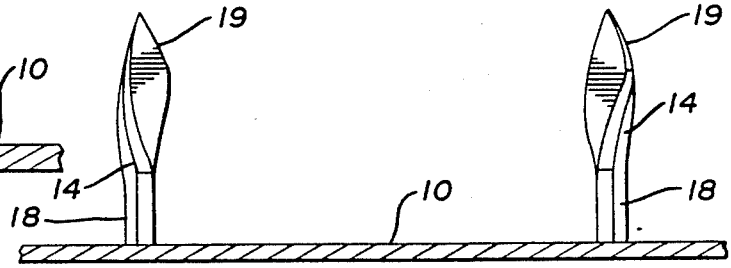
FIG. 5
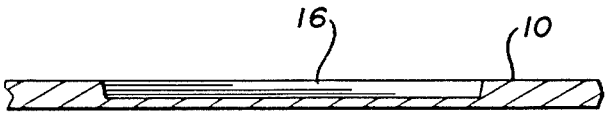
FIG. 4

METHOD OF MAKING A CONNECTOR PLATE

BACKGROUND OF THE INVENTION

1. Technical Field

This invention relates to connector plates sometimes called nailer plates, having a plurality of pairs of nail-like teeth perpendicular to the plane of the plate, struck therefrom, and having sharp knife-like edges on their outermost ends.

2. Description of the Prior Art

Connector plates of various dimensions for various purposes may be seen in U.S. Pat. Nos. 494,882, 3,225,643, 3,242,788, 3,731,583 and 4,209,265.

In U.S. Pat. No. 493,882, teeth termed "projections D" are formed in oppositely disposed relation in a metal plate and guards E are illustrated in the opposite ends of an L-shaped area of the plate from which they are formed. The teeth D or depending projections have continuous edges formed when a die stamps the same from the plate. The guards E are similarly formed and all of the edges of both the teeth or depending projections and the guards are those framed by the severence of the metal of the plate when the forming die strikes the same therefrom.

In U.S. Pat. No. 3,242,788, oppositely disposed pairs of teeth 14 and 14A are struck from a metal plate in which slits 16 and 17 are first formed so that the forming die need only bend the teeth to right angled positions with respect to the plane of the plate from which they are formed. The several edges of the teeth are those formed by the initial stamping die forming the slits in the metal plate.

The several other prior art patents mentioned hereinbefore form the teeth individually with a single die stamping operation and again the teeth have the usual edge configurations which results when sheet metal is torn by a stamping die.

The present invention forms each of the opposed pairs of teeth from one of a plurality of elongated rectangular areas in the sheet metal plate in which grooves have been initially formed by a first die diagonally with respect to the elongated rectangular area from which the opposed pair of teeth are to be formed by a stamping die. The diagonal grooves are preferably V-shaped in cross section and extend at least half way into the sheet metal plate and form sharp beveled surfaces which become sharp beveled edges on the ends of each of the teeth subsequently struck from the area. The resultant teeth, which are perpendicular to the plane of the sheet metal from which they are struck, have oppositely inclined outermost end portions which are the sharpened areas formed by the initial diagonally positioned grooves. Connector plates having teeth so formed require considerably less pressure to be engaged in connecting wooden members to be joined by the connector plates and completely avoid the previous tendency of teeth or nail-like projections of nailer plates as heretofore formed to tear or destroy an area of the wooden members larger than the area actually occupied by the teeth or nail-like projections.

3. SUMMARY OF THE INVENTION

A connector plate have perpendicularly extending teeth stamped therefrom, the outermost ends of which are angularly positioned and comprise sharpened edges formed by initially forming grooves diagonally of the area from which the teeth or nail-like projections are formed.

DESCRIPTION OF THE DRAWINGS

FIG. 1 is a side elevation of two intersecting wood members in abutting relation rigidly secured by a connector plate having opposed pairs of sharpened teeth arranged in perpendicular relation to said plate; FIG. 2 is a perspective view on an enlarged scale of a portion of a connector plate illustrating in broken lines areas from which opposed pairs of sharpened teeth are to be formed and a pair of said teeth;

FIG. 3 is a cross section on line 3—3 of FIG. 2;

FIG. 4 is a cross section on line 4—4 of FIG. 2;

FIG. 5 is a cross section on line 5—5 of FIG. 2.

DESCRIPTION OF THE PREFERRED EMBODIMENT

By referring to the drawings and FIG. 1 in particular, a connector plate 10 is illustrated rigidly securing two intersecting wood members 11 and 12 together in abutting relation. The nailer plate 10 has a plurality of elongated rectangular openings 13 remaining therein after the metal originally in each of the openings 13 has been formed in opposed pairs of sharp end perpendicular teeth 14 as best seen in FIG. 2 of the drawings.

By referring to FIG. 2 of the drawings, which is a substantially enlarged perspective view of a portion of the connector plate 10 of FIG. 1, it will be seen that pairs of parallel broken lines 15 are illustrated in spaced parallel relation on the connector plate 10 and that diagonally positioned grooves 16 have been formed in the connector plate 10 to a depth at least half the thickness of the nailer plate 10 and preferably in a V-shaped configuration as seen in the cross section comprising FIG. 3. It will be seen that each of the diagonally positioned grooves 16 extend across the parallel pairs of broken lines 15 which indiate the areas from which the sharp ended perpendicularly disposed teeth 14 are to be formed and still referring to FIG. 2 of the drawings and the left hand portion thereof, the sharp ended teeth 14 will be seen as formed from the metal originally in one of the openings 13 heretofore referred to. The teeth 14 are struck oppositely from the grooves 16.

In a preferred embodiment as illustrated, the pairs of broken lines 15 which represent the area from which one of the opposed pairs of sharp ended teeth 14 are formed have opposed pairs of small transverse shoulders 17 which result in the middle portion of the elongated opening 13 remaining after the teeth 14 are struck therefrom being narrower than the end portions and the resultant wider base portions 18 of each of the sharp ended perpendicular teeth 14. The outwardly upwardly extending portions of the sharp ended teeth 14 are thus somewhat narrower than the lower end portions 18 thereof which join the connector plate 18 in a right angular bend and enable the stamping die to impart a twist to the narrower upper portions of the sharp ended teeth 14.

The outermost ends of the sharp ended teeth 14 are beveled knife-like edges 19 formed by the sides of the V-shaped grooves 16 when the stamping die, not shown, engages the connector plate 10 and strikes the teeth 14 therefrom. The beveled outer ends have a sharpened edge which is defined by the small amount of metal between the bottom of the preferably V-shaped grooves 16 and the opposite side of the connector plate 10 as best seen in FIGS. 3 and 4 of the drawings.

FIG. 4 of the drawings is a longitudinal section on line 4—4 of FIG. 2 through one of the grooves 16.

By referring to FIG. 5 of the drawings, which like FIG. 4 and FIG. 3 is substantially enlarged with respect to FIG. 2 of the drawings, a section on line 5—5 of FIG. 2 will be seen to illustrate the twist of the metal forming the teeth 14 and leaving the beveled outermost ends 19 of the teeth 14 in their sharpened pointed relation where they are more easily pushed into the wooden members when the connector plate is pressed into wooden members to be joined to one another. It will occur to those skilled in the art that while the perpendicular teeth 14 as illustrated herein are shown with slightly bowed lower end portions joining the connector plate 10, which transverse bow is provided to strengthen the perpendicular teeth, the same may be formed without the transverse bow, which in itself is not new in the connector plate art.

The same is true with respect to the formation of the lower portions of the teeth 14 as being wider than their uppermost portions as the uppermost, outermost end of the teeth 14 comprises the essential patentable novelty in the present disclosure which results in the formation of struck out perpendicular teeth in a connector plate having beveled sharpened outermost end portions.

In will thus be seen that a substantial improvement in connector plates formed of sheet metal and the like has been disclosed and having thus described my invention, what I claim is:

1. A method of fabricating a connector plate with a plurality of sharp ended teeth from sheet steel of a known thickness having first and second substantially parallel surfaces comprising the steps of: forming in a first punching operation, elongated cross sectionally V-shaped grooves in said sheet steel inwardly of said first surface to a depth of at least half the known thickness of said sheet steel, forming, in a second punching operation a plurality of attached teeth in said sheet steel so that one end of each of said teeth is shaped by one inclined side surface of each of said plurality of elongated cross sectionally V-shaped grooves, and moving said punched teeth to positions at right angles to the surfaces of said sheet steel.

2. The method of fabricating a connector plate set forth in claim 1 and wherein said cross sectionally V-shaped elongated grooves are formed in sharply V-shaped configurations.

3. The method of fabricating a connector plate set forth in claim 1 and wherein punching each of said attached teeth includes cutting said sheet steel in a generally U-shaped outline, the base of the U-shape being oppositely disposed with respect to one of said elongated cross sectionally V-shaped grooves.

4. The method of fabricating a connector plate set forth in claim 1 and wherein the punching of said plurality of attached teeth engages said second surface and moves said punched teeth through said first surface.

* * * * *